US006701670B2

(12) United States Patent
Evans

(10) Patent No.: US 6,701,670 B2
(45) Date of Patent: Mar. 9, 2004

(54) PULLEY FOR DOUBLE HUNG WINDOWS

(76) Inventor: Gary Evans, P.O. Box 599, Bowral NSW 2576 (AU)

( * ) Notice: Subject to any disclaimer, the term of this patent is extended or adjusted under 35 U.S.C. 154(b) by 0 days.

(21) Appl. No.: 09/925,364

(22) Filed: Aug. 9, 2001

(65) Prior Publication Data

US 2002/0040553 A1 Apr. 11, 2002

(30) Foreign Application Priority Data

Oct. 8, 2000 (AU) ..... PQ 9332

(51) Int. Cl.[7] ..... E05C 7/06; F05F 17/00; B66D 3/04

(52) U.S. Cl. ..... 49/123; 49/73.1; 254/390

(58) Field of Search ..... 49/445–448, 73, 49/95, 116, 123, 181; 254/389, 390, 403, 411; 16/193–199, DIG. 16; D8/360

(56) References Cited

U.S. PATENT DOCUMENTS

| | | | | | |
|---|---|---|---|---|---|
| 842,701 | A | * | 1/1907 | Reiland | 49/445 |
| 2,226,721 | A | * | 12/1940 | Huff | 16/198 |
| 2,517,851 | A | * | 8/1950 | Dinsmore | 16/198 |
| 2,758,333 | A | * | 8/1956 | Monjar et al. | 16/198 |
| 2,789,323 | A | * | 4/1957 | Life et al. | 16/197 X |
| 2,921,348 | A | * | 1/1960 | Nardulli | 16/197 X |
| 2,952,884 | A | * | 9/1960 | Dinsmore | 16/197 X |
| 3,133,323 | A | * | 5/1964 | Robards | 16/197 X |
| 3,146,488 | A | * | 9/1964 | Dahlstrom | 16/198 |
| 3,358,403 | A | * | 12/1967 | Dinsmore | 49/445 |
| 3,475,864 | A | * | 11/1969 | Wood | 49/445 |
| 3,500,586 | A | * | 3/1970 | Johnson | 49/445 X |
| 4,134,234 | A | * | 1/1979 | Wood | 49/445 X |
| 4,170,090 | A | * | 10/1979 | Wood | 49/181 X |
| 4,413,445 | A | * | 11/1983 | Trout | 49/445 |
| 4,642,845 | A | * | 2/1987 | Marshik | 16/DIG. 16 X |
| 4,697,304 | A | * | 10/1987 | Overgard | 16/198 |
| 4,760,622 | A | * | 8/1988 | Rohrman | 16/196 |
| 4,914,862 | A | * | 4/1990 | Gregory | 49/445 |
| 4,935,987 | A | * | 6/1990 | Sterner, Jr. | 49/445 X |
| 5,119,591 | A | * | 6/1992 | Sterner, Jr. et al. | 49/445 X |

* cited by examiner

*Primary Examiner*—Hugh B. Thompson
(74) *Attorney, Agent, or Firm*—Molins and Co.

(57) ABSTRACT

A pulley apparatus (27) is disclosed which is adapted for use with a double hung wind. (10). The apparatus is used in pairs which are mounted in a recess (30) formed in the head (20) of the double hunt window. A pair of sash cords (25) are routed through the apparatuses and are attached to each sash so as to counterbalance one to the other, without the use of springs or extra weights.

3 Claims, 3 Drawing Sheets

PULLEY FOR DOUBLE HUNG WINDOWS

TECHNICAL FIELD

The invention pertains to double hung windows and also to a pulley system for counterbalancing, in a double hung window, one sash with the other sash.

BACKGROUND ART

A window sash consists of a window pane which is surrounded by a frame. A double hung window consists of an arrangement of two sashes, each of which may travel vertically in one of two pair of adjacent parallel grooves formed in the vertical stiles which abut or form a portion of the window's jamb. Various mechanisms are known whereby springs or counterweights are used to offset the effort required to raise a sash or correspondingly, to prevent the sash from falling under its own weight. Known methods of accomplishing this are considered complicated or expensive and many known methods are not suitable for retrofitting to existing windows.

According to one aspect of the invention there is provided a pulley apparatus for a double hung window comprising:

a base which supports a pair of pulleys each having an axle;

the base having a pair of ears which extend away from the pullies;

the base having a pair of cord openings each cord opening in registry with an outer extremity of a pulley so that the axles are between the openings.

MODES FOR CARRYING OUT THE INVENTION

Figure 1:
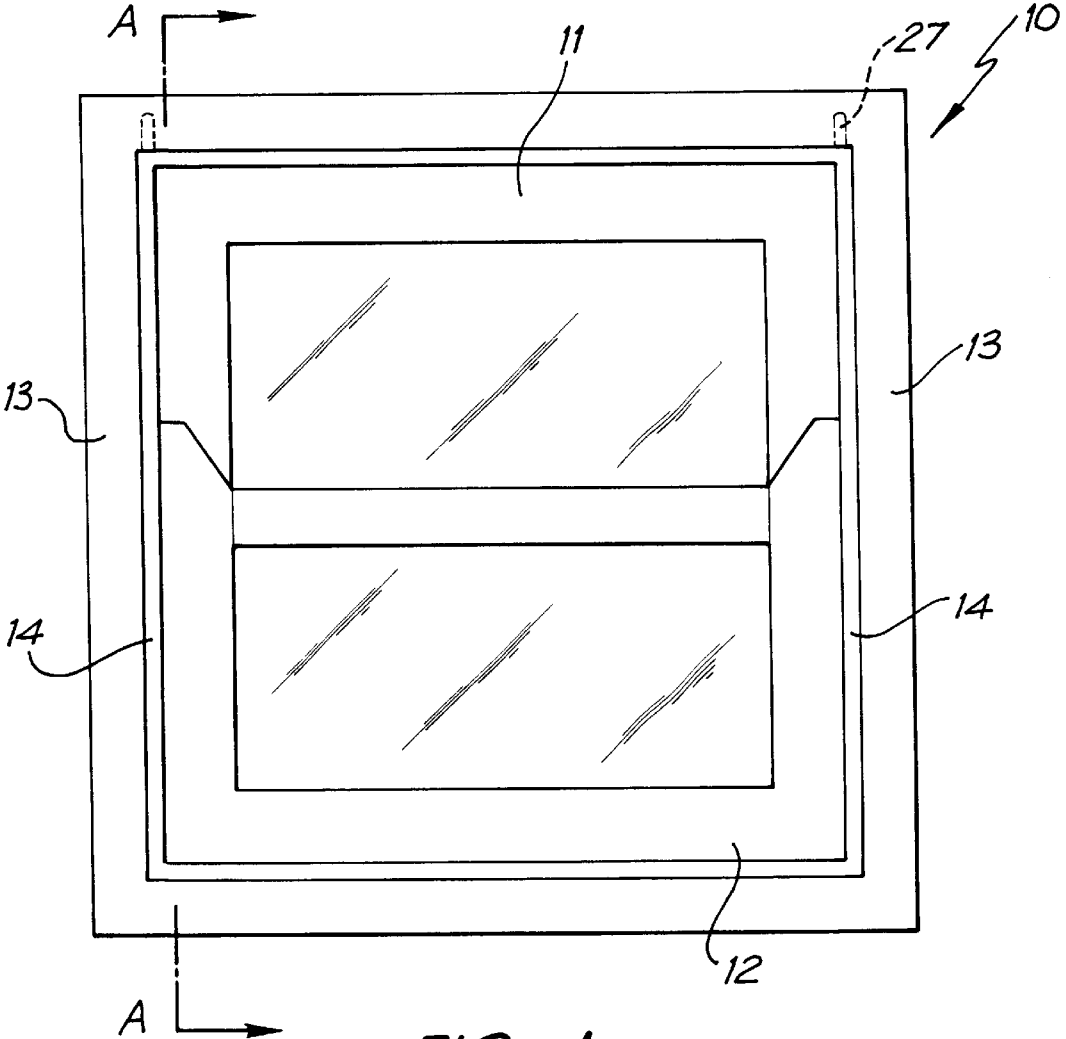
FIG. 1 is a front elevation of a double hung window.

FIG. 1 illustrates a double hung window 10. The window comprises upper and lower sashes 11, 12. The window frame includes vertical jambs 13. Each jamb 13 includes or is joined to a stile 14. Each stile 14 includes a pair of adjacent and parallel vertical tracks.

Figure 2:
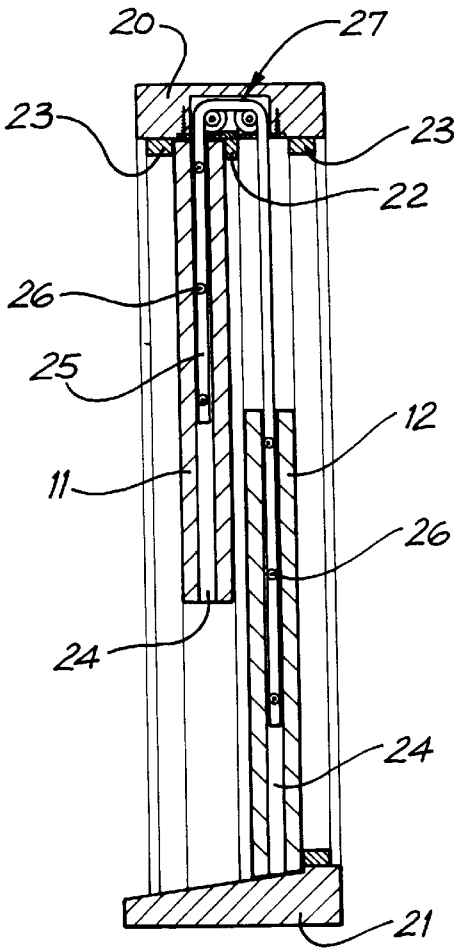
FIG. 2 is a cross-sectional view through lines A—A of FIG. 1.

As shown in FIG. 2, the window further comprises a head 20 and a sill 21. The full length vertical grooves in the stile 14 are defined by the central parting bead 22 and the pair of stop beads 23. These tracks guide the sashes in their vertical movement.

As further shown in FIG. 2, the pair of sashes 11, 12 are counterbalanced against one another. The vertical side edge of each sash 11, 12 is provided with a recess or groove 24. The groove 24 is sized to receive a sash cord 25 which is affixed by screws 26 or otherwise into the groove 24 and against the sash. A length of sash cord (equal to about half the length of the sash) is affixed in each groove 24.

In order that one sash counterbalances the other, a pulley device 27 is recessed into the window head 20 above each of the stiles 14. Each of the two sash cords 25 passes over a pulley device 27.

Figure 3:
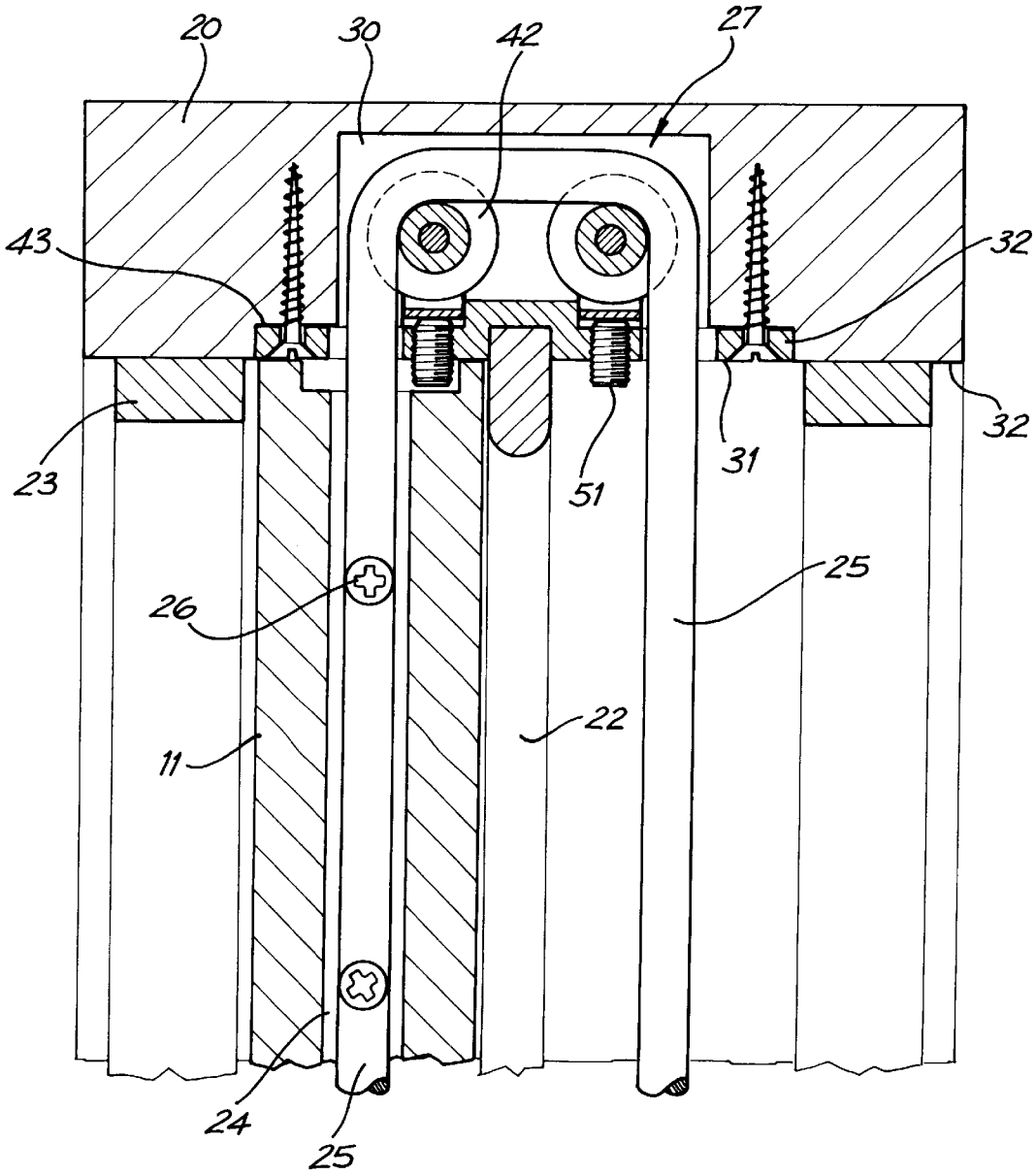
FIG. 3 is a cross-section of a sash and window head according to one embodiment of the present invention.
Figure 4:
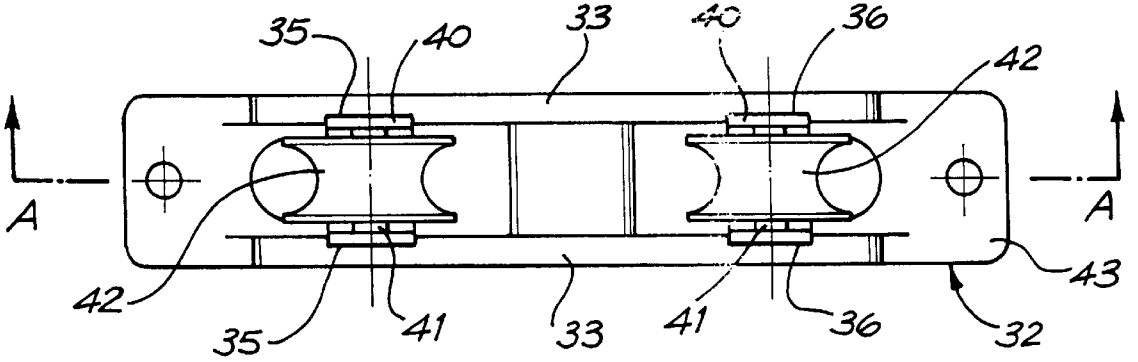
FIG. 4 is a top plan view of a pulley according to one embodiment of the invention.

As shown in FIG. 3, the pulley device 27 is located within a recess 30 formed within the window head 20. The outer or lower flat surface 31 of the pulley device 27 is generally flush with the lower surface 32 of the window head 20. The pulley device 27 comprises a base 32 which supports a pair of parallel side plates 33. As shown in FIG. 4, two pairs of opposing slots 35, 36 are formed into the interior facing surfaces of each side plate 33. Each of the pairs of slots 35, 36 receives a "U" shaped yoke 40, the yoke 40 supporting an axle 41 about which a pulley 42 rotates.

Figure 5:
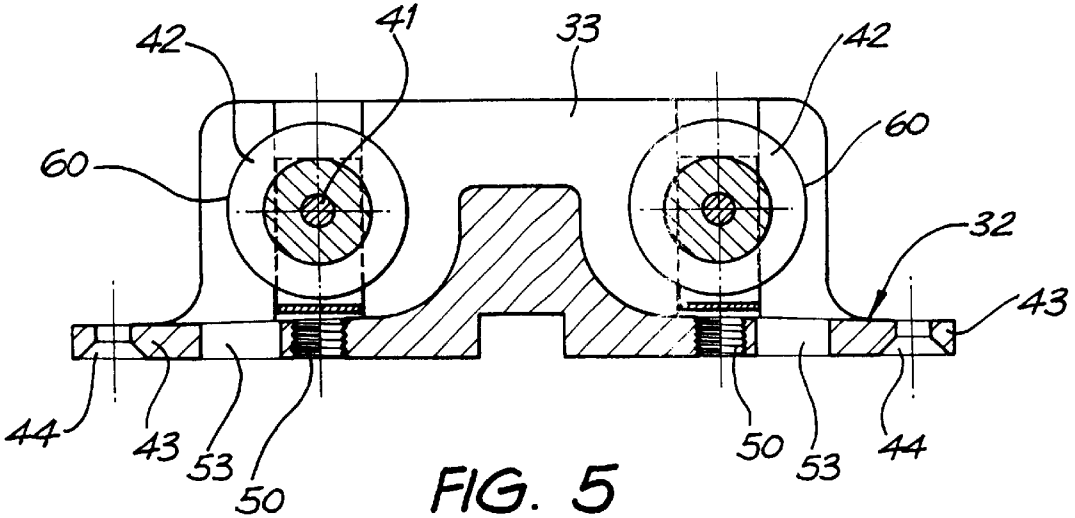
FIG. 5 is a cross-sectional view of the pulley depicted in FIG. 4, taken through lines A—A of FIG. 4.
Figure 6:
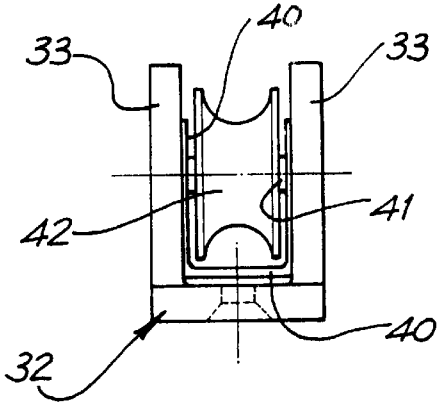
FIG. 6 is an end elevation of the pulley depicted in FIG. 5.

As shown in FIGS. 4 to 6, the base 32 includes ears 43 which extend away from the pullies and the underside of each ear 43 includes a through hole 44 which is preferably countersunk to permit the pulley device 27 to be mounted flush using a pan headed screw or the like with the lower surface 32 of the window head 20. The base 32 also incorporates a pair of openings 53 which allow the cord to pass around the pair of pulleys 42. The opening are in registry with an outer extremity 60 of a pulley, so that the axles 41 of both pullies are located between the openings 53.

One or both of the pulleys 42 may be made vertically adjustable by providing a vertical through opening 50 in the base 32 below the yoke 40. The threaded vertical opening 50 receives a threaded member, bolt or screw 51 which may be used to raise (or lower) the effective height of the yoke, axle and pulley above the base 32. IN the alternative, both pullies may be mounted in a common yoke for simultaneous adjustment. In this way, any slack in the sash cord 25 caused by stretching or ageing can be adjusted out.

It will be observed that this arrangement allows the pulleys to be mounted directly above the stile grooves and sash cord slots. The arrangement provides a suitable means of constructing new windows as well as a convenient means of retro-fitting existing double hung windows having broken or damaged counterweights or springs.

The present invention thereby provides a pulley device, a kit of parts and a method for retrofitting a window, hardware and a method for assembling a new window, and windows when fitted according to the teachings of the invention.

It will be appreciated that the above described system is a compact and efficient way of counterbalancing a sash in a window. It will be appreciated that the invention is preferably deployed in a timber window but that the invention may be extended into any window incorporating similar constructions methods, irrespective of the material in which it is constructed.

While the present invention has been described with reference to particular details of construction it should be understood as having been provided by way of example and not as limitations to the scope or spirit of the invention.

What is claimed is:

1. A springless sash window system, for a window having a head, comprising:

a pair of window sashes, a first and a second pulley apparatus, each of the apparatuses adapted to be mounted in a recess formed in the head, each of the pulley apparatuses comprising one or more pulleys, each of the pulleys rotating about an axle having a horizontal axis, and a first and second sash cord each cord configured to be routed through a respective one of the pulley apparatuses and each cord being attached at multiple locations to each sash of the pair of window sashes at opposing ends of the respective sash cord, so that each of the sashes are counterbalanced with the other sash, without the use of springs, via the first and second sash cords.

2. A springless sash window system, for a window having a head, comprising:

a pair of window sashes, a first and a second pulley apparatus, each of the apparatuses adapted to be mounted in a recess formed in the head, each of the pulley apparatuses comprising one or more pulleys, each of the pulleys rotating about an axle having a horizontal axis; a first and second sash cord each cord configured to be routed through a respective one or the pulley apparatuses and attached to each sash of the pair of window sashes at opposing ends of the respective sash cord, so that each of the sashes are counterbalanced with the other sash, without the use of springs, via the first and second sash cords;

each of the pulley apparatuses comprises a pair of ears which extend away from the one or more pulleys, each apparatus being adapted for mounting with the ears adapted to be flush with a lower surface of the head.

3. A springless sash window system, for a window having a head comprising:

a pair of window sashes, a first and a second pulley apparatus, each of the apparatuses adapted to be mounted in a recess formed in the head, each of the pulley apparatuses comprising one or more pulleys, each of the pulleys rotating about an axle having a horizontal axis; a first and second sash cord each cord configured to be routed through a respective one pulley apparatuses and attached to each sash of the pair of window sashes at opposing ends of the respective sash cord, so that each of the sashes are counterbalanced with the other sash, without the use of springs, via the first and second sash cords;

each apparatus further comprising a base which supports a yoke, the yoke supporting one axle and being vertically adjustable with respect to the base.

* * * * *